US007984821B1

(12) United States Patent
Malmberg

(10) Patent No.: US 7,984,821 B1
(45) Date of Patent: Jul. 26, 2011

(54) BUCKET ASSEMBLY FOR ANGLED SURFACES

(76) Inventor: Brant P. Malmberg, Medway, MA (US)

( * ) Notice: Subject to any disclaimer, the term of this patent is extended or adjusted under 35 U.S.C. 154(b) by 980 days.

(21) Appl. No.: 11/901,625

(22) Filed: Sep. 18, 2007

(51) Int. Cl.
*B65D 90/12* (2006.01)

(52) U.S. Cl. ..... 220/631; 220/628; 220/570; 248/148

(58) Field of Classification Search ..... 220/23.89, 220/631, 737, 628, 630; 248/148
See application file for complete search history.

(56) References Cited

U.S. PATENT DOCUMENTS

| | | | | | |
|---|---|---|---|---|---|
| 1,609,246 | A | * | 11/1926 | Hamburger | 47/39 |
| 1,700,666 | A | * | 1/1929 | Bright | 38/102.2 |
| 2,750,139 | A | * | 6/1956 | Young | 248/148 |
| D200,265 | S | | 2/1965 | Smith et al. | |
| 3,420,486 | A | * | 1/1969 | Baker | 248/210 |
| 4,325,503 | A | * | 4/1982 | Swinney | 224/148.6 |
| 4,519,565 | A | * | 5/1985 | Whitmore | 248/237 |
| 4,830,320 | A | * | 5/1989 | Bellows | 248/188.2 |
| 4,842,229 | A | * | 6/1989 | Murray | 248/148 |
| 4,962,906 | A | * | 10/1990 | Fatool et al. | 248/148 |
| 5,064,090 | A | * | 11/1991 | Farrier | 220/482 |
| 5,078,350 | A | * | 1/1992 | Zorichak | 248/148 |
| 5,163,591 | A | * | 11/1992 | Leiserson et al. | 224/148.6 |
| 5,217,193 | A | * | 6/1993 | Drucker | 248/148 |
| 5,232,187 | A | * | 8/1993 | O'Farrell et al. | 248/148 |
| 5,236,340 | A | * | 8/1993 | Hall et al. | 220/606 |
| 5,639,003 | A | * | 6/1997 | Utzinger, III | 224/577 |
| 5,730,339 | A | * | 3/1998 | Stolfo | 224/148.6 |
| 5,913,782 | A | * | 6/1999 | Monaco et al. | 52/126.1 |
| 6,006,966 | A | * | 12/1999 | Voisin, Jr. | 224/148.4 |
| 6,135,312 | A | * | 10/2000 | Chen | 220/737 |
| 6,138,965 | A | * | 10/2000 | Iorio et al. | 248/150 |
| 6,321,932 | B1 | * | 11/2001 | Butters, III | 220/737 |
| 6,533,227 | B1 | * | 3/2003 | Rom | 248/148 |
| D473,371 | S | * | 4/2003 | Bronstein et al. | D3/26 |
| 6,557,738 | B1 | * | 5/2003 | Meintzer | 224/148.7 |
| 6,688,485 | B1 | * | 2/2004 | Lauer et al. | 220/574 |
| 7,258,312 | B2 | * | 8/2007 | Grosse | 248/154 |
| 7,293,748 | B1 | * | 11/2007 | Hoser | 248/146 |
| 7,520,483 | B2 | * | 4/2009 | Rand et al. | 248/346.11 |
| 2002/0145001 | A1 | * | 10/2002 | Morelock | 220/755 |
| 2006/0226310 | A1 | * | 10/2006 | Hall et al. | 248/148 |

* cited by examiner

*Primary Examiner* — Anthony Stashick
*Assistant Examiner* — Christopher B McKinley
(74) *Attorney, Agent, or Firm* — T.L. Garrett, PLC; Tanya L. Garrett

(57) ABSTRACT

A bucket assembly for use on an angled surface comprising a bucket portion a base that supports the bucket portion and a swivel assembly, wherein the bucket portion operates to swivel with respect to the base of the bucket assembly via the swivel assembly so that the bucket assembly does not tip over or fall from the angled surface. A method of using the bucket assembly on an angled surface includes placing the bucket assembly on an angled surface and rotating the bucket portion about the base such that an upper peripheral edge of the bucket portion is substantially horizontal, thereby allowing a user to access a desired tool retained within the bucket assembly.

7 Claims, 2 Drawing Sheets

BUCKET ASSEMBLY FOR ANGLED SURFACES

FIELD OF THE INVENTION

The present invention generally relates to roofing tools and equipment and more particularly, relates to a bucket and support for supporting a bucket in a preformed altitude on a sloped roof.

BACKGROUND

Buckets are used extensively by workmen on roofing operations. Such operations include surfacing and repairing or replacement of surfaces. The buckets that are used are typically of the round cylindrical type with a hinged handle for carrying them. However these buckets are in advantageously used in that when set to rest on a pitched roof the contents of the bucket tends to overflow the downhill side of the bucket since the bucket is at an angle to the horizontal. Further, these buckets tend to slide off the pitched roof.

Existing devices teach the use of buckets in roof installation and repair work. However, there is a need for a bucket that may be supported and oriented in an upright attitude by a non-slip surfaced base and provides stability for tools retained thereon or therein. The present invention fulfills these needs and provides further related advantages as described in the following summary.

SUMMARY

A bucket assembly for use on an angled surface comprising a bucket portion a base that supports the bucket portion and a swivel assembly, wherein the bucket portion operates to swivel with respect to the base of the bucket assembly via the swivel assembly so that the bucket assembly does not tip over or fall from the angled surface.

A method of using the bucket assembly on an angled surface includes placing the bucket assembly on an angled surface and rotating the bucket portion about the base such that an upper peripheral edge-of the bucket portion is substantially horizontal, thereby allowing a user to access a desired tool retained within the bucket assembly.

BRIEF DESCRIPTION OF THE DRAWINGS

These and other objects, features and advantages of the present invention will become apparent from the following detailed description and the appended drawings in which.

DETAILED DESCRIPTION

Figure 1:
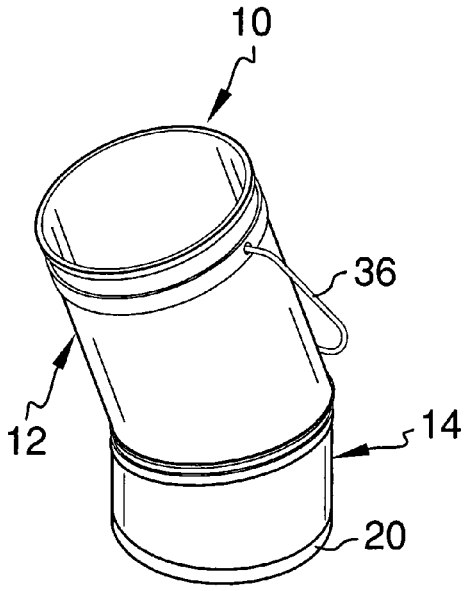
FIG. 1 illustrates a perspective view of a bucket assembly in accordance with one embodiment of the present invention.
Figure 2:
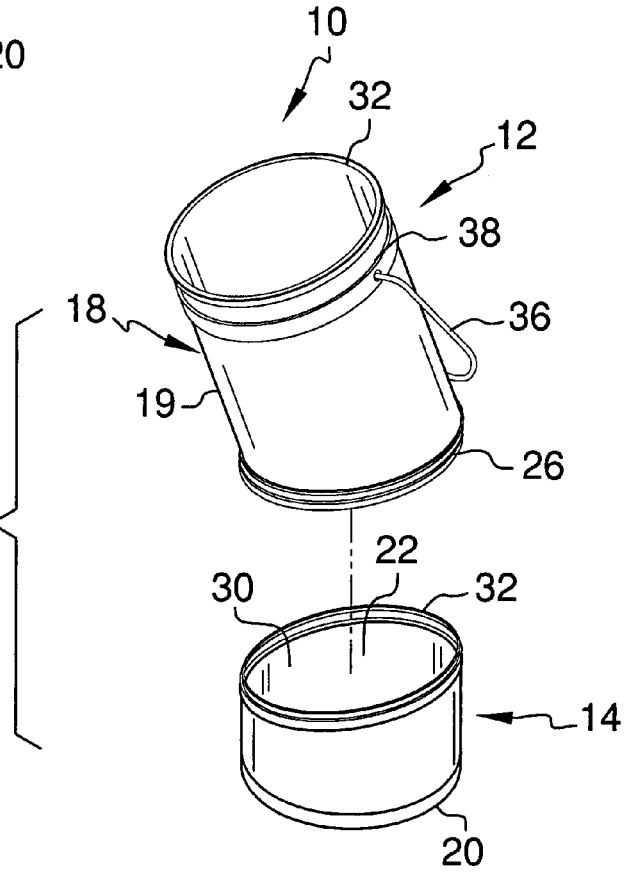
FIG. 2 illustrates an exploded perspective view of the bucket assembly shown in FIG. 1.
Figure 3:
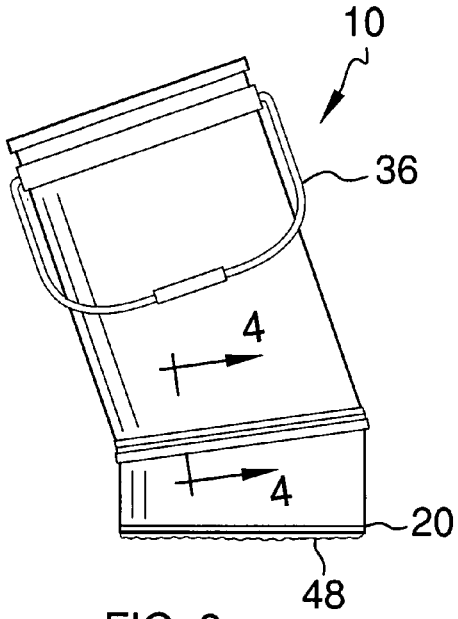
FIG. 3 illustrates a side elevational view of the bucket assembly shown in FIG. 1.

The bucket assembly of the present invention is a special bucket assembly that a contractor or do-it-yourselfer can use for temporarily holding hand tools, power tools, etc. when working on a pitched roof of a residence.

The above described drawing figures illustrate the invention, a bucket assembly capable of being used in construction trades for carrying water, solvents, waterproofing compounds and the like.

As shown in FIGS. 1-5, a bucket assembly 10 includes a bucket portion 12 and a base 14, wherein the bucket portion 12 swivels with respect to the base 14 via a swivel assembly 16 so that the assembly 10 does not tip over or fall from the angled or inclined surface such as a roof. The base and bucket portions are preferably constructed of a moldable material such as plastic or metal.

The base 14 has a cylindrical base-body part 18 and is defined by a closed end 20 at one end thereof, and integral thereto, a sidewall 9 with an upper peripheral edge 28 at an open opposing end 30. The upper peripheral edge 28 is set at an angle to a longitudinal axis 22 of the cylindrical base body part, so that the assembly 10 may be set onto a non-horizontal angled surface with the longitudinal axis 22 of the body part 18 plumb, i.e., perpendicular to the angled surface.

The closed end 20 has a non-slip exterior surface 48 which may be made with a rough surface finish or it may have a rubber, neoprene or silicone coating, or other high friction material applied or layer attached. The non-slip exterior surface 48 prevents the assembly 10 from slipping on any type of angled surface such as a roof covering.

Figure 5:
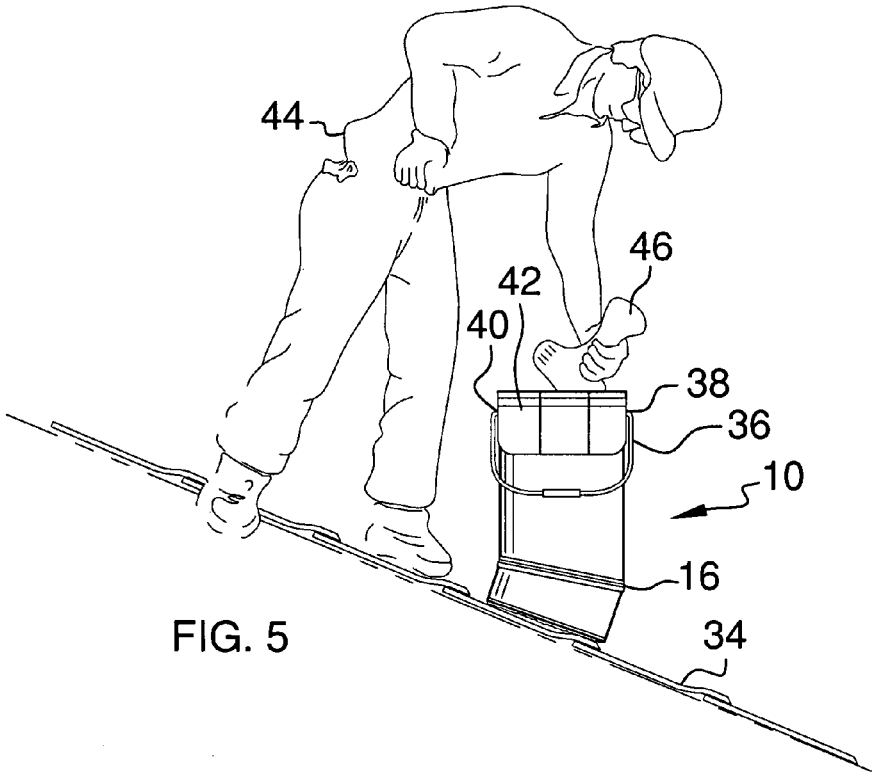
FIG. 5 illustrates an in use view of the bucket assembly shown in FIG. 1 positioned on a roof.

The bucket portion 12 includes a cylindrical-shaped open ended body 24 having a lower peripheral edge 26 adapted to mate with the upper peripheral edge 28 of the base 14, and an upper peripheral edge 32 that may be horizontally oriented when the bucket assembly 10 is placed on an angled or inclined surface such as the roof 34 shown in FIG. 5. The open ended body 24 extends away from the longitudinal axis 22 of the base 14 at an angle.

Figure 4:
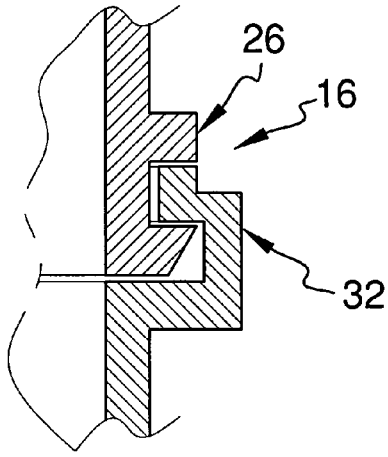
FIG. 4 illustrates a partial cross-sectional view of the bucket assembly shown in FIG. 3 taken across sectional line 4-4.

The swivel assembly 16 as shown in more detail in FIG. 4 is adapted to allow the bucket portion 12 to swivel with respect to the base 14. The upper peripheral edge 28 of the base 14 and the lower peripheral edge 26 of the bucket portion are complementary in shape and cooperates form the swivel assembly 16.

The bucket assembly 10 further includes a carrying handle 36 engaged near the bucket portion upper peripheral edge 32 which is adapted, by its mounting and by its size, for rotating from a vertical position and for carrying the assembly 10 to a rest position, as shown in FIGS. 1-5, at one side of the bucket assembly 10. The carry handle 36 is mounted rotationally in a pair of handle mounting bosses 38, 40 molded integrally to the bucket portion 12 as shown in the figures.

Also, in another embodiment of the invention, as shown in FIG. 5 a tool belt 42 may be removably attached to the upper peripheral edge 32 of the bucket portion 12 for storage of various tools.

FIG. 5 illustrates an in-use view of the bucket assembly 10 wherein the assembly 10 is placed on the angled surface 34 and wherein the bucket portion 12 is rotated about the base 14 such that the bucket portion upper peripheral edge 32 is substantially horizontal, thereby allowing a user 44 to access a desired tool 46 retained within the bucket assembly 10.

The bucket assembly 10 fulfills the need for a very easy method for temporarily storing tools and other items when working on a pitched roof.

The bucket assembly 10 provides ease of use, light weight, portability, timesavings, optimum size, reasonable price, and an ability to provide an increased level of safety for any individual working on a pitched roof. Users, including, but not limited to roofing contractors and do-it-yourselfers may find the bucket assembly quite helpful, in that the users would not need to worry about tools and other times slipping from a roof and falling to the ground.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the aspects of the technology without departing from the spirit and scope of the appended claims.

What is claimed is:

1. A bucket assembly for use on an angled surface comprising:

a bucket portion, wherein the bucket portion includes:

a cylindrical-shaped open ended body that extends away from the longitudinal axis of the base at an angle having a lower peripheral edge adapted to mate with the upper peripheral edge of the base, and an upper peripheral edge that may be horizontally oriented when the bucket assembly is placed on an angled surface;

a base that supports the bucket portion, wherein the base includes a closed end at one end thereof, and integral thereto, an open end opposing the closed end, and a sidewall with an upper peripheral edge at the open end, wherein the upper peripheral edge is set at an angle to a longitudinal axis of the cylindrical base-body so that when the bucket assembly is set onto the angled surface, the longitudinal axis of the cylindrical base-body part is perpendicular to the angled surface; and a swivel assembly, wherein the bucket portion operates to swivel with respect to the base of the bucket assembly via the swivel assembly so that the bucket assembly does not tip over or fall from the angled surface.

2. The bucket assembly of claim 1, wherein the closed end of the base comprises:

a non-slip exterior surface that operates to prevent the bucket assembly from slipping on any type of angled surface.

3. The bucket assembly of claim 1, wherein the swivel assembly is defined by the upper peripheral edge of the base and the lower peripheral edge of the bucket portion to allow the bucket portion to swivel with respect to the base.

4. The bucket assembly of claim 1, further comprising:

a carrying handle engaged near the bucket portion upper peripheral edge which is adapted for carrying the bucket assembly.

5. The bucket assembly of claim 1, wherein each of the base and the bucket portions comprise:

a moldable material.

6. The bucket assembly of claim 1, further comprising:

a tool belt removably attached to an upper peripheral edge of the bucket portion for storage of tools.

7. A method of using a bucket assembly on an angled surface comprising:

providing a bucket assembly including a bucket portion, wherein the bucket portion includes:

a cylindrical-shaped open ended body that extends away from the longitudinal axis of the base at an angle having a lower peripheral edge adapted to mate with the upper peripheral edge of the base, and an upper peripheral edge that may be horizontally oriented when the bucket assembly is placed on an angled surface;

a base that supports the bucket portion, wherein the base includes:

a closed end at one end thereof, and integral thereto, an open end opposing the closed end, and a sidewall with an upper peripheral edge at the open end, wherein the upper peripheral edge is set at an angle to a longitudinal axis of the cylindrical base-body so that when the bucket assembly is set onto the angled surface, the longitudinal axis of the cylindrical base-body part is perpendicular to the angled surface, a swivel assembly that allows the bucket portion to swivel with respect to the base of the bucket assembly;

placing the bucket assembly on an angled surface; and rotating the bucket portion about the base such that an upper peripheral edge of the bucket portion is substantially horizontal, thereby allowing a user to access a desired tool retained within the bucket assembly.

* * * * *